US011292039B2

(12) United States Patent
Yamashita

(10) Patent No.: US 11,292,039 B2
(45) Date of Patent: Apr. 5, 2022

(54) METHOD FOR PRODUCING H-SHAPED STEEL

(71) Applicant: NIPPON STEEL CORPORATION, Tokyo (JP)

(72) Inventor: Hiroshi Yamashita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/648,474

(22) PCT Filed: Jan. 11, 2019

(86) PCT No.: PCT/JP2019/000690

§ 371 (c)(1),
(2) Date: Mar. 18, 2020

(87) PCT Pub. No.: WO2019/142734

PCT Pub. Date: Jul. 25, 2019

(65) Prior Publication Data

US 2020/0282438 A1 Sep. 10, 2020

(30) Foreign Application Priority Data

Jan. 19, 2018 (JP) ..... JP2018-007095

(51) Int. Cl.
*B21B 1/08* (2006.01)
*B21B 1/088* (2006.01)

(52) U.S. Cl.
CPC ..... *B21B 1/088* (2013.01)

(58) Field of Classification Search
CPC ..... B21B 1/08; B21B 1/085; B21B 1/088; B21B 1/0883; B21B 1/0886; B21B 1/095; B21B 27/02; B21B 27/024; B21D 47/01
(Continued)

(56) References Cited

U.S. PATENT DOCUMENTS 4,402,206 A * 9/1983 Yanazawa ..... D06M 15/673 72/221
4,420,961 A * 12/1983 Kusaba ..... B21B 1/088 72/221

FOREIGN PATENT DOCUMENTS

JP 57-146405 A 9/1982
JP 57-171501 A 10/1982
(Continued)

OTHER PUBLICATIONS

International Search Report for PCT/JP2019/000690 dated Feb. 19, 2019.

(Continued)

*Primary Examiner* — Debra M Sullivan

(74) *Attorney, Agent, or Firm* — Birch, Stewart, Kolasch & Birch, LLP

(57) ABSTRACT

A large-size H-shaped steel product is produced by performing a rough rolling step including an edging rolling step of rolling and shaping a material to be rolled into a predetermined almost dog-bone shape, and a flat rolling step of performing rolling of a web part by rotating the material to be rolled after completion of the edging rolling step by 90° or 270°, upper and lower caliber rolls of at least one caliber of calibers configured to perform the flat rolling step include recessed parts configured to form a raised part at a middle of a web part of the material to be rolled, the recessed parts being provided at roll barrel length middle parts of the upper and lower caliber rolls.

4 Claims, 6 Drawing Sheets

(58) Field of Classification Search
USPC ..... 72/252.5
See application file for complete search history.

(56) References Cited

FOREIGN PATENT DOCUMENTS

| | | | |
|---|---|---|---|
| JP | 7-88501 | A | 4/1995 |
| WO | WO 2018/029869 | A1 | 2/2018 |

OTHER PUBLICATIONS

Written Opinion of the International Searching Authority for PCT/JP2019/000690 (PCT/ISA/237) dated Feb. 19, 2019.

* cited by examiner

METHOD FOR PRODUCING H-SHAPED STEEL

CROSS-REFERENCE TO RELATED APPLICATIONS

This application is based upon and claims the benefit of priority of the prior Japanese Patent Application No. 2018-007095, filed in Japan on Jan. 19, 2018, the entire contents of which are incorporated herein by reference.

TECHNICAL FIELD

The present invention relates to a production method for producing H-shaped steel using, for example, a slab having a rectangular cross section or the like as a raw material.

BACKGROUND ART

In the case of producing H-shaped steel, a raw material such as a slab or a bloom extracted from a heating furnace is shaped into a raw blank (a material to be rolled in a so-called dog-bone shape) by a rough rolling mill (BD). A web and flanges of the raw blank are subjected to reduction in thickness by an intermediate universal rolling mill, and flanges of the material to be rolled are subjected to width reduction and forging and shaping of end surfaces by an edger rolling mill close to the intermediate universal rolling mill. Then, an H-shaped steel product is shaped by a finishing universal rolling mill.

In such a method for producing H-shaped steel, for shaping the raw blank in the so-called dog-bone shape from the slab raw material having a rectangular cross section, there is a known technique of creating splits on slab end surfaces in a first caliber at a rough rolling step, then widening the splits or making the splits deeper in second and subsequent calibers, and eliminating the splits on the slab end surfaces in calibers subsequent thereto (refer to, for example, Patent Document 1).

Besides, in production of the H-shaped steel, it is known that after so-called edging rolling of edging the end surfaces of the raw material such as a slab (slab end surfaces), flat shaping and rolling is performed in which the material to be rolled is rotated by 90° or 270° and reduction of a web corresponding part is performed. In this flat shaping and rolling, reduction and shaping of a flange corresponding part is performed together with the reduction of the web corresponding part, and when a large-size raw material is used as a material to be rolled at a time of shaping a large-size H-shaped steel product with a large web height, various problems such as elongation in a web height direction and deformation of the flange corresponding part may arise in general flat shaping and rolling, and correction of the shape is sometimes required. Concretely, there is a concern about a phenomenon that with the reduction of the web corresponding part, the web corresponding part elongates in the longitudinal direction and the flange corresponding part also elongates in the longitudinal direction drawn by the elongation of the web corresponding part, resulting in a decrease in thickness of the flange corresponding part.

Regarding such flat shaping and rolling, for example, Patent Document 2 discloses a technique of selectively performing reduction on the web corresponding part, in which an unreduced portion is provided at the middle of the web corresponding part, a formed protruding part (corresponding to a raised part of the present invention) is thereafter eliminated, and the web corresponding part is widened, thereby efficiently producing large-size H-shaped steel.

PRIOR ART DOCUMENT

Patent Document

Patent Document 1: Japanese Laid-open Patent Publication No. H7-88501

Patent Document 2: Japanese Laid-open Patent Publication No. S57-146405

DISCLOSURE OF THE INVENTION

Problems to be Solved by the Invention

As described above, recently, with an increase in size of structures and the like, production of a large-size H-shaped steel product having a large web height and a large flange width is desired. In particular, a product having flanges, which greatly contribute to strength and rigidity of H-shaped steel, made wider as compared with conventional ones is desired. To produce the H-shaped steel product with widened flanges, it is necessary to shape a material to be rolled with a flange width larger as compared with a conventional one from the shaping at the rough rolling step.

The technique disclosed in Patent Document 1 described above is the method of creating the splits on the end surfaces of the raw material such as a slab (slab end surfaces), edging the end surfaces, and performing the rough rolling utilizing the width spread. However, in the method of performing the rough rolling as described above, there is a limit in broadening of the flanges. Namely, in order to broaden the flanges in conventional rough rolling methods, techniques such as wedge designing (designing of a split angle), reduction adjustment, and lubrication adjustment are used to improve the width spread. However, since none of the methods greatly contributes to a flange width, the rate of width spread, which represents the rate of a spread amount of the flange width to an edging amount, is about 0.8 even under a condition that the efficiency at the initial stage of edging is the highest. In addition, it is known that the rate of width spread decreases as the spread amount of the flange width increases under a condition that edging is repeated in the same caliber, and finally becomes about 0.5. It is also conceivable to increase the size of the raw material such as a slab itself to increase the edging amount, but, there are circumstances where sufficient broadening of product flanges is not realized because there are device limits in facility scale, reduction amount, and so on of the rough rolling mill.

Further, when producing the large-size H-shaped steel product, a large-size raw blank is sometimes rolled and shaped in the rough rolling step. In the case of rolling and shaping the large-size raw blank in a method different from the conventional one and shaping the shape of the raw blank into a shape closer to the H-shaped steel, it is known that there arise problems such as elongation in a web height direction and deformation of a flange corresponding part when the flat shaping and rolling is performed by the technique described in the above Patent Document 2.

In consideration of the above points, the present inventors evaluated in the whole comprehensive process including the elimination of the unreduced portion in the subsequent process. Concretely, the present inventors have found out that, as explained in a later-described embodiment of the present invention, the width of the unreduced portion is set to a width of 25% or more and 50% or less of a web part inner size of the material to be rolled, for example, when a 300 thick slab is used as a raw material to increase the generation efficiency of the flanges. Besides, the present inventors have found out that, regarding the unreduced portion, poor material passage occurs during flat shaping and rolling due to a difference in shape between reduced portions and the unreduced portion in the web of the material to be rolled, leading to defective shape in some cases, and reached the present invention.

In consideration of the above circumstances, an object of the present invention is to provide a technique for efficiently and stably producing a large-size H-shaped steel product by performing flat shaping and rolling of a large-size raw blank while improving a generation efficiency of flanges without bringing about problems such as elongation in a web height direction and deformation of a flange corresponding part in the flat shaping and rolling which is performed after so-called edging rolling of creating deep splits on end surfaces of a rectangular cross-section raw material such as a slab using projections in acute-angle tip shapes, and sequentially bending flange parts formed by the splits to obtain a cross section of roughly-shaped H-shaped steel having a larger flange width as compared with a conventional one in a rough rolling step using a caliber when producing H-shaped steel.

Means for Solving the Problems

To achieve the above object, according to the present invention, there is provided a method for producing H-shaped steel, the method including: a rough rolling step; an intermediate rolling step; and a finish rolling step, wherein: a rectangular cross-section slab having a thickness of 290 mm or more and 310 mm or less is used as a raw material; the rough rolling step includes: an edging rolling step of rolling and shaping a material to be rolled into a predetermined almost dog-bone shape; and a flat rolling step of performing rolling of a web part by rotating the material to be rolled after completion of the edging rolling step by 90° or 270°; upper and lower caliber rolls of at least one caliber of calibers configured to perform the flat rolling step include recessed parts configured to form a raised part at a middle of a web part of the material to be rolled, the recessed parts being provided at roll barrel length middle parts of the upper and lower caliber rolls; a width of the raised part formed in the flat rolling step is set to 25% or more and 50% or less of a web part inner size of the material to be rolled; and a thickness of the web part rolled in the flat rolling step is set to a predetermined thickness thicker than a web part thickness when the intermediate rolling step is started.

The calibers configured to perform the flat rolling step may further include a raised part eliminating caliber configured to reduce the raised part, with respect to the material to be rolled formed with the raised part.

The calibers configured to perform the flat rolling step may further include one or a plurality of widening calibers configured to roll and shape the web part almost flat and perform widening rolling of the web part with respect to the material to be rolled after being rolled and shaped by the raised part eliminating caliber.

The thickness of the web part rolled in the flat rolling step may also be set to a predetermined thickness whose lower limit value is expressed by the following formula (3), $$Y=-0.118X^2+11.732X-121.15 \quad (3)$$

where Y indicates a web thickness (mm), and X indicates an escaping percentage (%).

It is also adoptable that a rolling mill configured to perform the rough rolling step is engraved with a plurality of calibers configured to roll and shape the material to be rolled, the number of the plurality of calibers being six or more; shaping in one or a plurality of passes is performed on the material to be rolled in the plurality of calibers; a first caliber and a second caliber of the plurality of calibers are formed with projections configured to create splits vertical to a width direction of the material to be rolled so as to form divided parts at end parts of the material to be rolled; and the calibers after a third caliber except the calibers configured to perform the flat rolling step located at subsequent stages of the plurality of calibers are formed with projections configured to come into contact with the splits and sequentially bend the formed divided parts.

Effect of the Invention

According to the present invention, it becomes possible to, in the rough rolling step using a caliber when producing H-shaped steel, create deep splits on end surfaces of a rectangular cross-section raw material such as a slab using projections in acute-angle tip shapes, and sequentially bend flange parts formed by the splits to shape a so-called dog bone from the rectangular cross-section slab, and then to perform, in flat shaping and rolling, flat shaping and rolling of a large-size raw blank while improving a generation efficiency of flanges without bringing about problems such as elongation in a web height direction and deformation of a flange corresponding part.

BEST MODE FOR CARRYING OUT THE INVENTION

Figure 1:
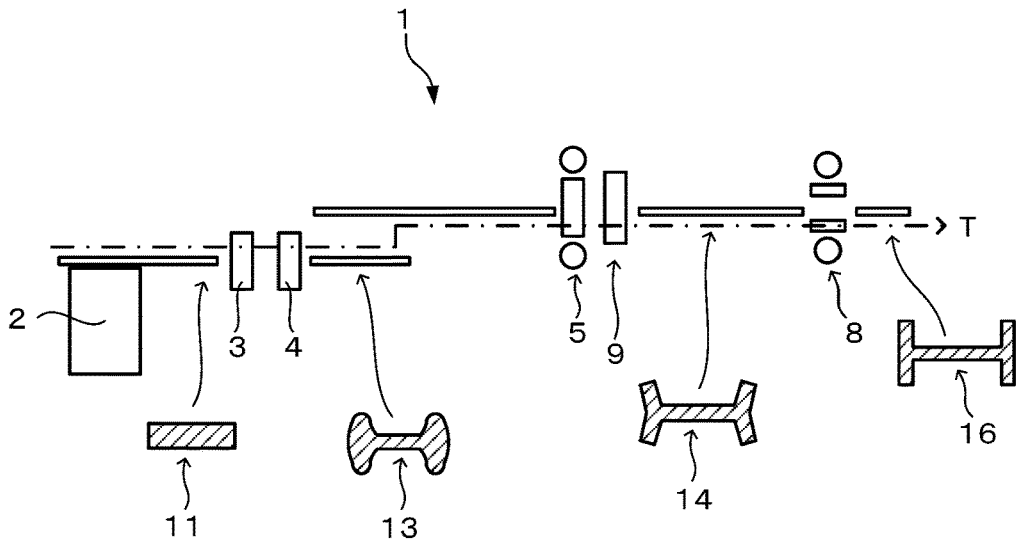
FIG. 1 is a schematic explanatory view about a production line for H-shaped steel.

Hereinafter, an embodiment of the present invention will be explained while referring to the drawings. Note that in this description and the drawings, components having substantially the same function or substantially the same configuration are denoted by the same codes to omit duplicated explanation.

FIG. 1 is an explanatory view about a production line T for H-shaped steel including a rolling facility 1 according to the present embodiment. As illustrated in FIG. 1, in the production line T, a heating furnace 2, a sizing mill 3, a rough rolling mill 4, an intermediate universal rolling mill 5, and a finishing universal rolling mill 8 are arranged in order from the upstream side. Further, an edger rolling mill 9 is provided close to the intermediate universal rolling mill 5. Note that, hereinafter, a steel material in the production line T is collectively described as a "material to be rolled A" for the sake of explanation, and its shape is appropriately illustrated using broken lines, oblique lines and the like in some cases in the respective drawings.

As illustrated in FIG. 1, in the production line T, for example, a rectangular cross-section raw material (a later-described material to be rolled A) being a slab 11 extracted from the heating furnace 2 is subjected to rough rolling in the sizing mill 3 and the rough rolling mill 4. Then, the rectangular cross-section raw material is subjected to intermediate rolling in the intermediate universal rolling mill 5. During the intermediate rolling, reduction is performed on a flange tip part of the material to be rolled by the edger rolling mill 9 as necessary. In a normal case, an edging caliber and a so-called flat shaping caliber of thinning a web portion to form the shape of a flange part are engraved on rolls of the sizing mill 3 and the rough rolling mill 4, and an H-shaped raw blank 13 is shaped by reverse rolling in a plurality of passes through those calibers, and the H-shaped raw blank 13 is subjected to application of reduction in a plurality of passes using a rolling mill train composed of two rolling mills of the intermediate universal rolling mill 5 and the edger rolling mill 9, whereby an intermediate material 14 is shaped. The intermediate material 14 is then subjected to finish rolling into a product shape in the finishing universal rolling mill 8, whereby an H-shaped steel product 16 is produced.

Here, a slab thickness of the slab 11 extracted from the heating furnace 2 is, for example, within a range of 290 mm or more and 310 mm or less. This is the dimension of a slab raw material called a so-called 300 thick slab used when producing a large-size H-shaped steel product.

Next, caliber configurations and caliber shapes engraved on the sizing mill 3 and the rough rolling mill 4 illustrated in FIG. 1 will be explained while referring to the drawings. FIG. 2 to FIG. 7 are schematic explanatory views about calibers engraved on the sizing mill 3 and the rough rolling mill 4 which perform a rough rolling step. All of a first caliber to a sixth caliber explained herein may be engraved, for example, on the sizing mill 3, or six calibers of the first caliber to the sixth caliber may be engraved separately on the sizing mill 3 and the rough rolling mill 4. Specifically, the first caliber to the sixth caliber may be engraved across both the sizing mill 3 and the rough rolling mill 4, or may be engraved on one of the rolling mills. At the rough rolling step in production of standard H-shaped steel, shaping in one or a plurality of passes is performed in each of the calibers.

Besides, a case where there are six calibers to be engraved will be described as an example in the present embodiment, and the number of the calibers does not always need to be six, but may be a plural number such as six or less or six or more. For example, a configuration that a general widening rolling caliber is provided at a stage subsequent to a later-described sixth caliber K6 is adoptable. In short, the caliber configuration only needs to be suitable for shaping the H-shaped raw blank 13. Note that in FIG. 2 to FIG. 7, a schematic final pass shape of the material to be rolled A in shaping in each caliber is illustrated by broken lines.

Figure 2:
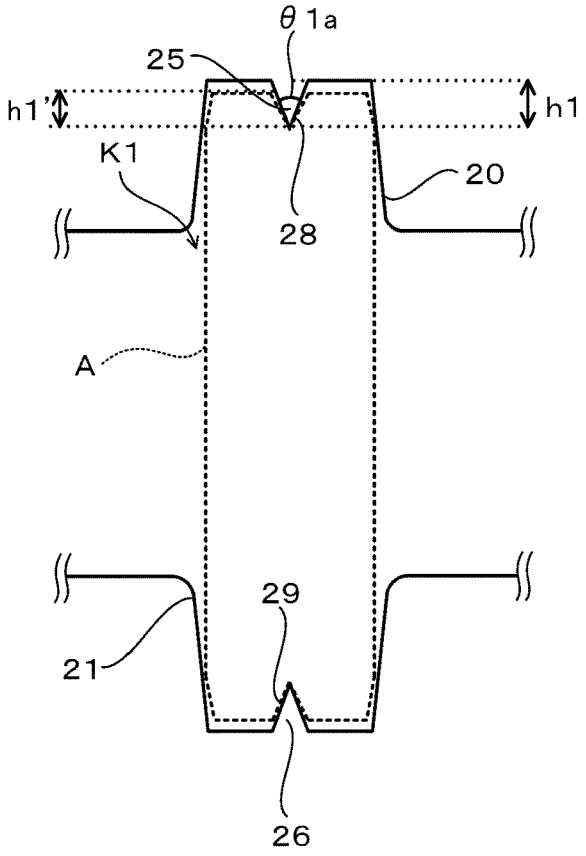
FIG. 2 is a schematic explanatory view of a first caliber.

FIG. 2 is a schematic explanatory view of a first caliber K1. The first caliber K1 is engraved on an upper caliber roll 20 and a lower caliber roll 21 which are a pair of horizontal rolls, and the material to be rolled A is subjected to reduction and shaping in a roll gap between the upper caliber roll 20 and the lower caliber roll 21. Further, a peripheral surface of the upper caliber roll 20 (namely, an upper surface of the first caliber K1) is formed with a projection 25 protruding toward the inside of the caliber. Further, a peripheral surface of the lower caliber roll 21 (namely, a bottom surface of the first caliber K1) is formed with a projection 26 protruding toward the inside of the caliber. These projections 25, 26 have tapered shapes, and dimensions such as a protrusion length of the projection 25 and the projection 26 are configured to be equal to each other. A height (protrusion length) of the projections 25, 26 is set to h1 and a tip part angle thereof is set to θ1*a*.

In the first caliber K1, the projections 25, 26 are pressed against upper and lower end parts (slab end surfaces) of the material to be rolled A, to thereby form splits 28, 29. Here, a tip part angle (also called a wedge angle) θ1*a* of the projections 25, 26 is desirably, for example, 25° or more and 40° or less.

Here, a caliber width of the first caliber K1 is preferably substantially equal to the thickness of the material to be rolled A (namely, a slab thickness). Concretely, when the width of the caliber at the tip parts of the projections 25, 26 formed in the first caliber K1 is set to be the same as the slab thickness, a right-left centering property of the material to be rolled A is suitably ensured. Further, it is preferable that such a configuration of the caliber dimension brings the projections 25, 26 and parts of caliber side surfaces (side walls) into contact with the material to be rolled A at upper and lower end parts (slab end surfaces) of the material to be rolled A during shaping in the first caliber K1 as illustrated in FIG. 2 so as to prevent active reduction at the upper surface and the bottom surface of the first caliber K1 from being performed on the slab upper and lower end parts divided into four elements (parts) by the splits 28, 29. This is because the reduction by the upper surface and the bottom surface of the caliber causes elongation of the material to be rolled A in the longitudinal direction to decrease the generation efficiency of the flanges (later-described flange parts 80). In other words, in the first caliber K1, a reduction amount at the projections 25, 26 (reduction amount at wedge tips) at the time when the projections 25, 26 are pressed against the upper and lower end parts (slab end surfaces) of the material to be rolled A to form the splits 28, 29 is made sufficiently larger than a reduction amount at the slab upper and lower end parts (reduction amount at slab end surfaces), to thereby form the splits 28, 29.

Figure 3:
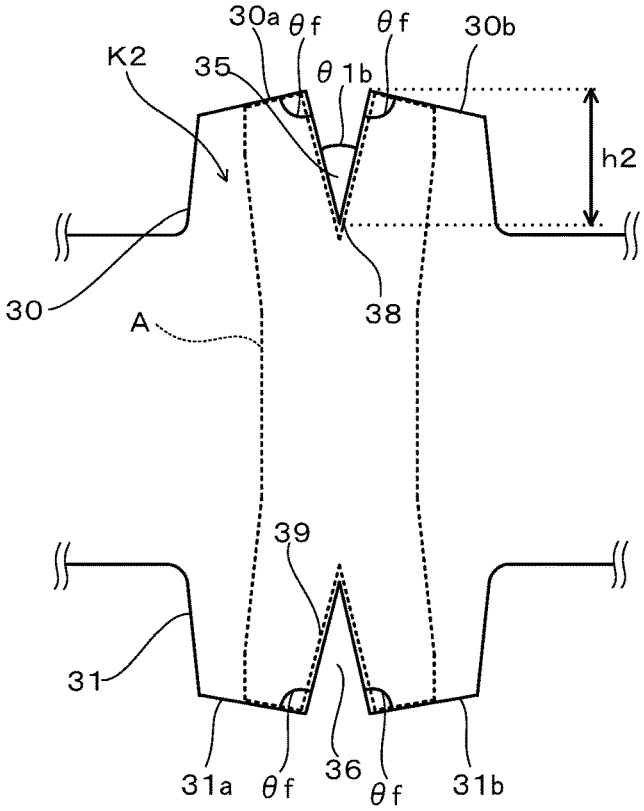
FIG. 3 is a schematic explanatory view of a second caliber.

FIG. 3 is a schematic explanatory view of a second caliber K2. The second caliber K2 is engraved on an upper caliber roll 30 and a lower caliber roll 31 which are a pair of horizontal rolls. A peripheral surface of the upper caliber roll 30 (namely, an upper surface of the second caliber K2) is formed with a projection 35 protruding toward the inside of the caliber. Further, a peripheral surface of the lower caliber roll 31 (namely, a bottom surface of the second caliber K2) is formed with a projection 36 protruding toward the inside of the caliber. These projections 35, 36 have tapered shapes, and dimensions such as a protrusion length of the projection 35 and the projection 36 are configured to be equal to each other. A tip part angle of the projections 35, 36 is desirably a wedge angle θ1*b* of 25° or more and 40° or less.

Note that the wedge angle θ1*a* of the above first caliber K1 is preferably the same angle as the wedge angle θ1*b* of the second caliber K2 at a subsequent stage in order to ensure the thickness of the tip parts of the flange corresponding parts, enhance inductive property, and secure stability of rolling.

A height (protrusion length) h2 of the projections 35, 36 is configured to be larger than the height h1 of the projections 25, 26 of the first caliber K1 so as to be h2>h1. Further, the tip part angle of the projections 35, 36 is preferably the same as the tip part angle of the projections 25, 26 in the first caliber K1 in terms of rolling dimension accuracy. In a roll gap between the upper caliber roll 30 and the lower caliber roll 31, the material to be rolled A after passing through the first caliber K1 is further shaped.

Here, the height h2 of the projections 35, 36 formed in the second caliber K2 is larger than the height h1 of the projections 25, 26 formed in the first caliber K1, and an intrusion length into the upper and lower end parts (slab end surfaces) of the material to be rolled A is also similarly larger in the second caliber K2. An intrusion depth into the material to be rolled A of the projections 35, 36 in the second caliber K2 is the same as the height h2 of the projections 35, 36. In other words, an intrusion depth h1' into the material to be rolled A of the projections 25, 26 in the first caliber K1 and the intrusion depth h2 into the material to be rolled A of the projections 35, 36 in the second caliber K2 satisfy the relation of h1'<h2.

Further, angles θf formed between caliber upper surfaces 30*a*, 30*b* and caliber bottom surfaces 31*a*, 31*b* facing the upper and lower end parts (slab end surfaces) of the material to be rolled A, and, inclined surfaces of the projections 35, 36, are configured to be about 90° (almost right angle) at all of four locations illustrated in FIG. 3.

Since the intrusion length of the projections at the time when pressed against the upper and lower end parts (slab end surfaces) of the material to be rolled A is large as illustrated in FIG. 3, shaping is performed to make the splits 28, 29 formed in the first caliber K1 deeper in the second caliber K2, to thereby form the splits 38, 39. Note that based on the dimensions of the splits 38, 39 formed here, a flange half-width at the end of a flange shaping step at the rough rolling step is decided.

Figure 4:
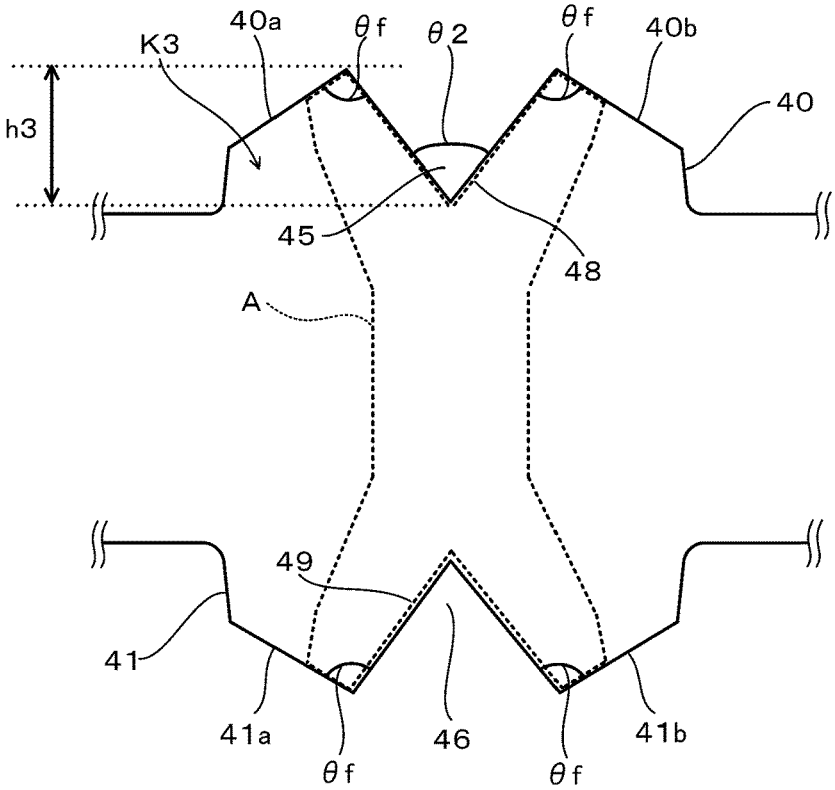
FIG. 4 is a schematic explanatory view of a third caliber.

FIG. 4 is a schematic explanatory view of a third caliber K3. The third caliber K3 is engraved on an upper caliber roll 40 and a lower caliber roll 41 which are a pair of horizontal rolls. A peripheral surface of the upper caliber roll 40 (namely, an upper surface of the third caliber K3) is formed with a projection 45 protruding toward the inside of the caliber. Further, a peripheral surface of the lower caliber roll 41 (namely, a bottom surface of the third caliber K3) is formed with a projection 46 protruding toward the inside of the caliber. These projections 45, 46 have tapered shapes, and dimensions such as a protrusion length of the projection 45 and the projection 46 are configured to be equal to each other.

A tip part angle θ2 of the projections 45, 46 is configured to be larger than the aforementioned angle θ1*b*, and an intrusion depth h3 into the material to be rolled A of the projections 45, 46 is smaller than the intrusion depth h2 of the above projections 35, 36 (namely, h3<h2). The angle θ2 is preferably, for example, 70° or more and 110° or less.

Further, angles θf formed between caliber upper surfaces 40*a*, 40*b* and caliber bottom surfaces 41*a*, 41*b* facing the upper and lower end parts (slab end surfaces) of the material to be rolled A, and, inclined surfaces of the projections 45, 46, are configured to be about 90° (almost right angle) at all of four locations illustrated in FIG. 4.

As illustrated in FIG. 4, in the third caliber K3, the splits 38, 39 formed in the second caliber K2 at the upper and lower end parts (slab end surfaces) of the material to be rolled A after passing through the second caliber K2 become splits 48, 49 by the projections 45, 46 being pressed against thereon. Specifically, in a final pass in shaping in the third caliber K3, a deepest part angle (hereinafter, also called a split angle) of the splits 48, 49 becomes 02. In other words, shaping is performed so that divided parts (the parts corresponding to the later-described flange parts 80) shaped along with the formation of the splits 38, 39 in the second caliber K2 are bent outward.

Figure 5:
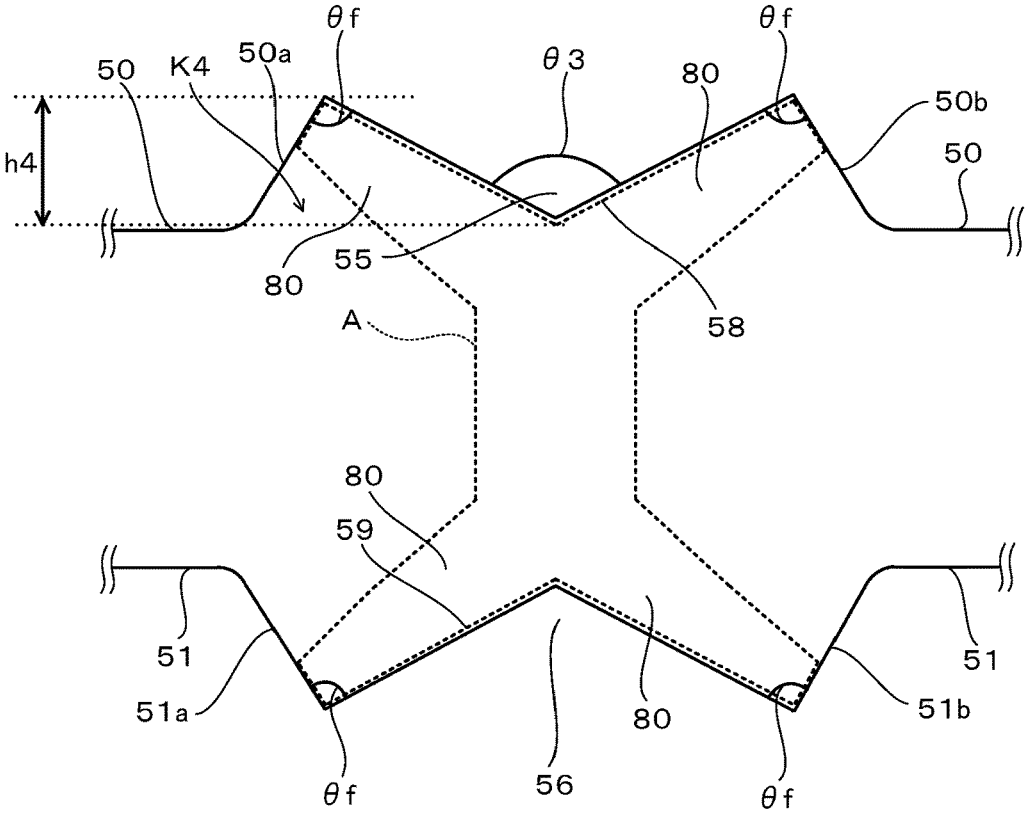
FIG. 5 is a schematic explanatory view of a fourth caliber.

FIG. 5 is a schematic explanatory view of a fourth caliber K4. The fourth caliber K4 is engraved on an upper caliber roll 50 and a lower caliber roll 51 which are a pair of horizontal rolls. A peripheral surface of the upper caliber roll 50 (namely, an upper surface of the fourth caliber K4) is formed with a projection 55 protruding toward the inside of the caliber. Further, a peripheral surface of the lower caliber roll 51 (namely, a bottom surface of the fourth caliber K4) is formed with a projection 56 protruding toward the inside of the caliber. These projections 55, 56 have tapered shapes, and dimensions such as a protrusion length of the projection 55 and the projection 56 are configured to be equal to each other.

A tip part angle θ3 of the projections 55, 56 is configured to be larger than the aforementioned angle θ2, and an intrusion depth h4 into the material to be rolled A of the projections 55, 56 is smaller than the intrusion depth h3 of the projections 45, 46 (namely, h4<h3). The angle θ3 is preferably, for example, 130° or more and 170° or less.

Further, angles θf formed between caliber upper surfaces 50*a*, 50*b* and caliber bottom surfaces 51*a*, 51*b* facing the upper and lower end parts (slab end surfaces) of the material to be rolled A, and, inclined surfaces of the projections 55, 56, are configured to be about 90° (almost right angle) at all of four locations illustrated in FIG. 5 similarly to the above third caliber K3.

In the fourth caliber K4, the splits 48, 49 formed in the third caliber K3 at the upper and lower end parts (slab end surfaces) of the material to be rolled A after passing through the third caliber K3 are pressed to spread by the projections 55, 56 being pressed against thereon, to thereby become splits 58, 59. Specifically, in a final pass in shaping in the fourth caliber K4, a deepest part angle (hereinafter, also called a split angle) of the splits 58, 59 becomes θ3. In other words, shaping is performed so that divided parts (the parts corresponding to the later-described flange parts 80) shaped along with the formation of the splits 48, 49 in the third caliber K3 are further bent outward. The parts of the upper and lower end parts of the material to be rolled A shaped in this manner are parts corresponding to flanges of a later-described H-shaped steel product and called the flange parts 80 herein.

The rolling and shaping using the above first caliber K1 to fourth caliber K4 is also called an edging rolling step of shaping the material to be rolled A into a predetermined almost dog-bone shape, and is implemented in a state where the raw material slab having a rectangular cross section is erected.

Figure 6:
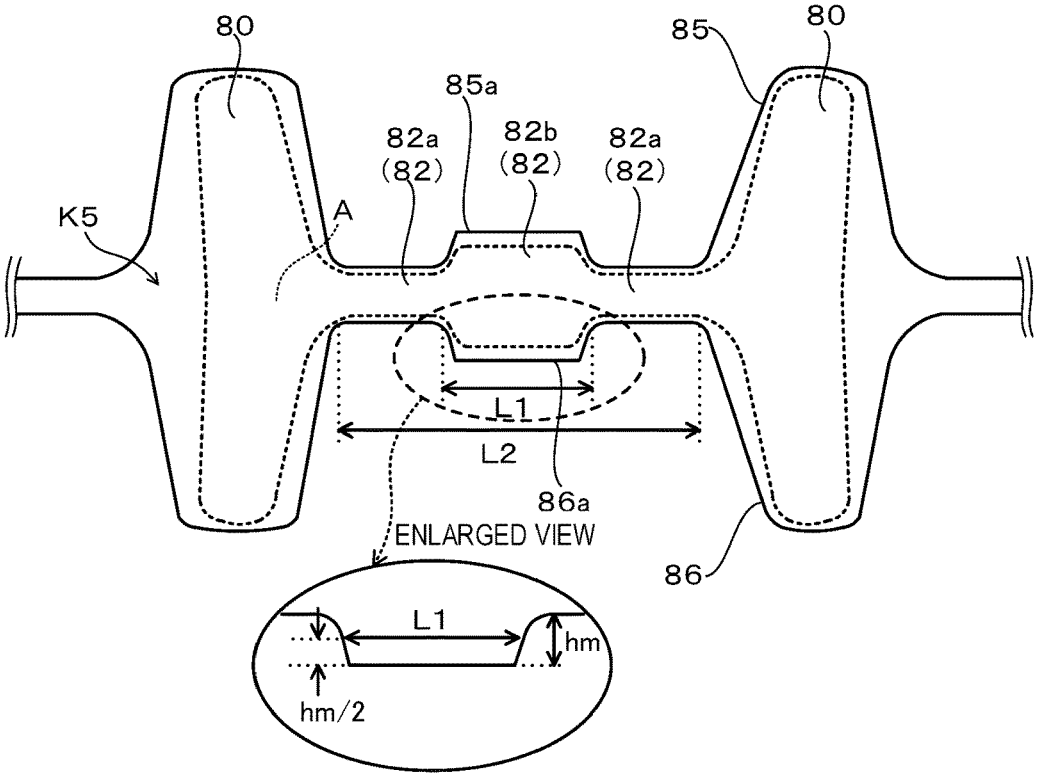
FIG. 6 is a schematic explanatory view of a fifth caliber.

FIG. 6 is a schematic explanatory view of a fifth caliber K5. The fifth caliber K5 is composed of an upper caliber roll 85 and a lower caliber roll 86 which are a pair of horizontal rolls. As illustrated in FIG. 6, in the fifth caliber K5, the material to be rolled A shaped until the fourth caliber K4 is rotated by 90° or 270°, whereby the flange parts 80 located at the upper and lower ends of the material to be rolled A until the fourth caliber K4 are located on a rolling pitch line. Then, in the fifth caliber K5, reduction of the web part 82 being a connecting part connecting the flange parts 80 at two positions is performed.

Here, upper and lower caliber rolls 85, 86 of the fifth caliber K5 have shapes formed with recessed parts 85*a*, 86*a* of a predetermined length L1 at their roll barrel length middle parts. With such a caliber configuration illustrated in FIG. 6, the reduction of the web part 82 is partially performed, so that in the web part 82 after the reduction, reduced portions 82*a* at both ends in the web height direction and a raised part 82*b* as an unreduced portion at the middle part thereof are formed. In this manner, the rolling and shaping of forming the raised part 82*b* in the web part 82 is performed in a material to be rolled in a so-called dog-bone shape.

Note that since the rolling and shaping of partially reducing the web part 82 to form the raised part 82*b* is implemented in the fifth caliber K5, this caliber is also called a "web partial rolling caliber" or a "raised part forming caliber". Further, the same length as the width length of the raised part 82*b* after the formation is the same length (a later-described escaping amount L1) as the width length L1 of the recessed parts 85*a*, 86*a*. Herein, as illustrated in the enlarged view in FIG. 6, the width length L1 of the recessed parts 85*a*, 86*a* in this description is defined as a width length at a depth of ½ of a depth hm of the recessed parts 85*a*, 86*a*.

Note that regarding the rolling and shaping in the fifth caliber K5, detailed rolling and shaping conditions thereof (the escaping amount L1 and so on) will be described later in more detail based on the finding and so on obtained by the present inventors in the explanation of the present embodiment.

Figure 7:
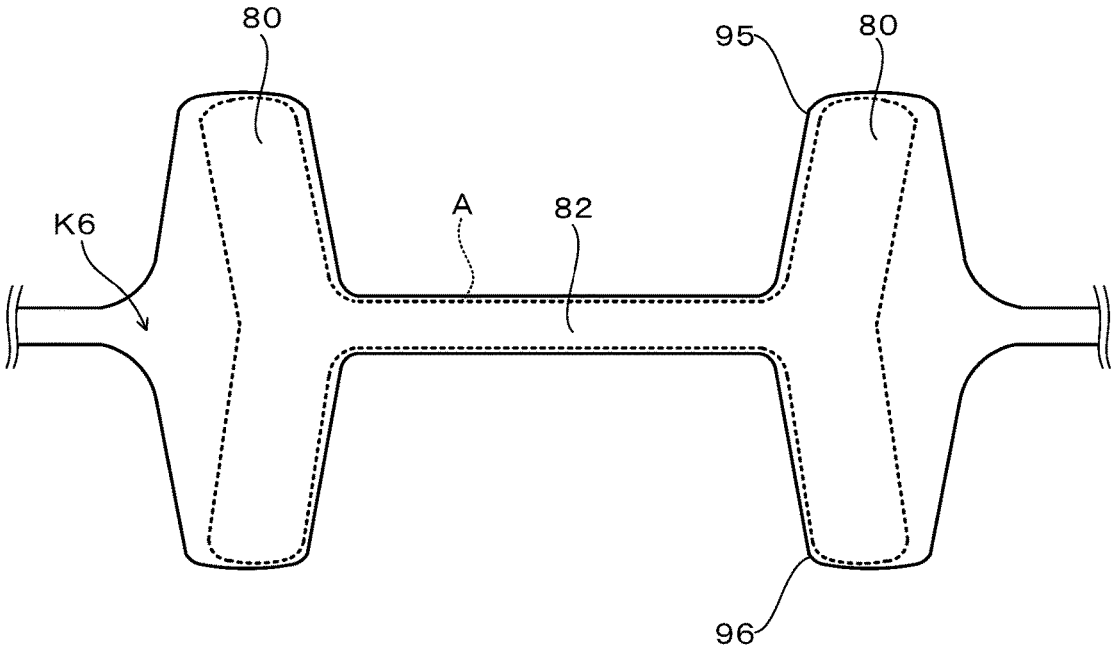
FIG. 7 is a schematic explanatory view of a sixth caliber.

FIG. 7 is a schematic explanatory view of a sixth caliber K6. The sixth caliber K6 is composed of an upper caliber roll 95 and a lower caliber roll 96 which are a pair of horizontal rolls. In the sixth caliber K6, the rolling and shaping of eliminating the raised part 82*b* formed in the web part 82 and widening the inner size of the web part 82 is performed, through rolling in a plurality of passes, on the material to be rolled A rolled and shaped in the fifth caliber K5.

In the sixth caliber K6, the rolling of bringing the upper and lower caliber rolls 95, 96 into contact with the raised part 82*b* formed in the web part 82 to reduce (eliminate) the raised part 82*b* is performed. The rolling and shaping by the sixth caliber K6 makes it possible to promote spread of the inner size in the web height direction (namely, widening) and the metal flow to the flange parts 80 accompanying the reduction of the raised part 82*b*, to thereby implement the rolling and shaping without causing decrease in area of the flange as much as possible. Further, from a viewpoint such that the decrease in area of the flange is not caused as much as possible, the caliber configuration of the sixth caliber K6 may also have a shape such as restraining outer surfaces of the flange parts 80 positioned on a rolling pitch line. Namely, the upper and lower caliber rolls 95, 96 may also be provided with side walls which come into contact with the outer surfaces of the flange parts 80.

The sixth caliber K6 eliminates the raised part 82*b* formed in the web part 82, and is therefore also called a "raised part eliminating caliber".

Further, the material to be rolled A through the first caliber K1 to the sixth caliber K6 described above may be further subjected to the reduction in thickness and the widening rolling of the web part 82 as needed. In this case, at a stage subsequent to the rolling and shaping in the sixth caliber K6, it is only necessary to perform the widening rolling using one or a plurality of widening calibers. Note that since the caliber for the reduction in thickness and the widening rolling in that case is a conventionally known caliber, the explanation of the caliber for the widening rolling is omitted in this description.

The rolling and shaping using the above fifth caliber K5 and sixth caliber K6 (and the widening caliber as needed) is implemented in an almost H-shaped attitude in which the material to be rolled A shaped at the edging rolling step is rotated by 90° or 270°, and is therefore also called flat rolling and shaping or a flat rolling step.

The H-shaped raw blank 13 illustrated in FIG. 1 is shaped using the first caliber K1 to the sixth caliber K6 as described above and the caliber for widening rolling as needed. The H-shaped raw blank 13 shaped as described above is subjected to application of reverse rolling in a plurality of passes using the rolling mill train composed of two rolling mills of the intermediate universal rolling mill 5 and the edger rolling mill 9 being known rolling mills, whereby an intermediate material 14 is shaped. The intermediate material 14 is then subjected to finish rolling into a product shape in the finishing universal rolling mill 8, whereby an H-shaped steel product 16 is produced (refer to FIG. 1).

In the method for producing H-shaped steel according to the present embodiment, the first caliber K1 to the fourth caliber K4 are used to create splits in the upper and lower end parts (slab end surfaces) of the material to be rolled A and perform processing of bending to right and left the respective portions separated to right and left by the splits to perform the shaping of forming the flange parts 80 as explained above, thereby enabling shaping of the H-shaped raw blank 13 without performing substantial vertical reduction of the upper and lower end surfaces of the material to be rolled A (slab). In short, it becomes possible to shape the H-shaped raw blank 13 having the flange width made wider as compared with the rough rolling method of reducing at all times the slab end surfaces conventionally performed, resulting in production of a final product (H-shaped steel) having a large flange width.

Here, the present inventors further conducted a study regarding the rolling and shaping with the use of the fifth caliber K5 and the sixth caliber K6 according to the present embodiment, and they found out that when performing the rolling and shaping using the sixth caliber K6 which eliminates the raised part 82*b* formed through the rolling and shaping in the fifth caliber K5, poor material passage sometimes occurs, and due to the poor material passage, the shape of the material to be rolled A is broken in some cases. In view of this finding, the present inventors conducted a study in more detail regarding conditions under which, in the rolling and shaping of eliminating the raised part 82*b* with the use of the sixth caliber K6, stable rolling and shaping can be performed without causing the poor material passage. Hereinafter, this study will be described while referring to the drawings, graphs, and so on.

(Ratio of Escaping Amount (Raised Part Forming Width) in Web Inner Size)

As described above, in the fifth caliber K5 (refer to FIG. 6) according to the present embodiment, the raised part 82*b* is formed at the middle of the web part 82 of the material to be rolled A, and the formed raised part 82*b* is eliminated in the sixth caliber K6 at the subsequent stage. Then, the widening rolling of the web inner size is performed as needed after the elimination of the raised part, to thereby shape the H-shaped raw blank, and in order to produce a large-size H-shaped steel product having a larger flange width as compared with the conventional one, the flange width of the H-shaped raw blank is also desired to be made as large as possible.

The present inventors found out that, by changing the width length L1 of the raised part 82*b* formed in the fifth caliber K5 (namely, the escaping amount of the web inner size in the rolling and shaping in the fifth caliber K5), there is generated a difference in the flange width of the finally obtained H-shaped raw blank. This is attributed to the fact that the flange thickness amount is more easily ensured with an increase in width length of the raised part 82*b*, but, on the other hand, the flange width decreases by the drawing action in the longitudinal direction of the material to be rolled A at the time of the subsequent elimination of the raised part.

Accordingly, in order to define a suitable range of the escaping amount of the web inner size (which is simply described also as "escaping amount L1", hereinafter) in the rolling and shaping in the fifth caliber K5, the present inventors focused attention on the relation between the escaping percentage and the increase/decrease of the flange width after the shaping of the H-shaped raw blank, and derived the preferable numerical value range of the escaping percentage. Note that the escaping percentage is a value defined by the following formula (1).

$$\text{Escaping percentage [\%]} = (\text{escaping amount } L1)/\text{web inner size } L2) \times 100 \quad (1)$$

Figure 8:
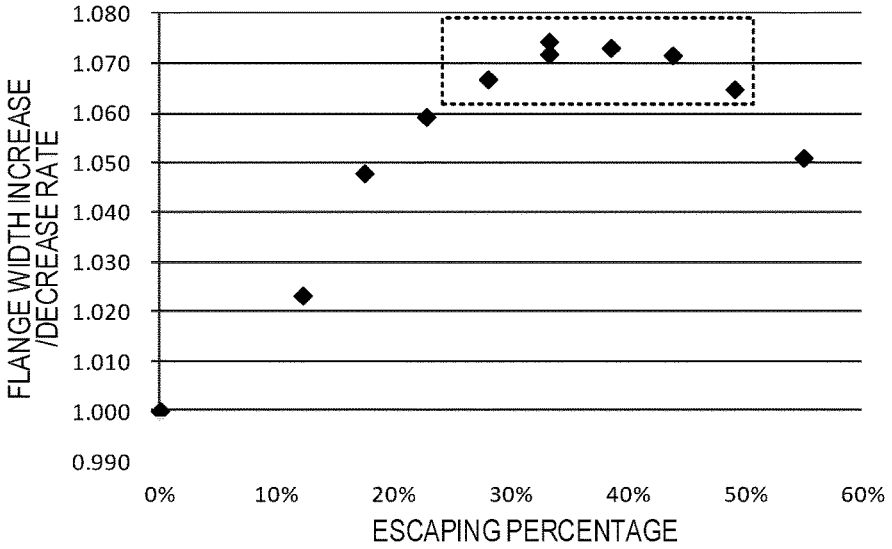
FIG. 8 is a graph indicating the relation between an escaping percentage and a flange width increase/decrease rate after the shaping of the H-shaped raw blank.

FIG. 8 is a graph indicating the relation between the escaping percentage and the flange width increase/decrease rate after the shaping of the H-shaped raw blank. Note that the flange width increase/decrease rate in FIG. 8 is a value indicating the flange width in the case where the escaping percentage is each value (12% to 56%) using the flange width in the case of the escaping percentage of 0% as a reference (1.000).

As illustrated in FIG. 8, the flange width of the H-shaped raw blank tends to increase with an increase in the escaping percentage, and the flange width increase/decrease indicates an almost fixed value (refer to a broken line part in the graph) in a region where the escaping percentage is about 25% or more.

In consideration that the rolling and shaping of increasing also the flange width of the H-shaped raw blank is desired in the case of producing a large-size H-shaped steel product having a larger flange width as compared with the conventional one, it can be understood from the result indicated in FIG. 8 that the numerical value range of the escaping percentage is desirably set to 25% to 50%.

(Material Passage Property During Elimination of Raised Part)

As described above, it was found out, from the result in FIG. 8, that the numerical value range of the escaping percentage when forming the raised part 82*b* is desirably set to 25% to 50%. Meanwhile, from a viewpoint of material passage property, there is a need to further conduct a study regarding a value of a thickness of the reduced portions 82*a* of the web when forming the raised part 82*b* at the escaping percentage in such a numerical value range. For example, when, after forming the raised part 82*b*, the rolling and shaping for eliminating the raised part 82*b* is performed in the sixth caliber K6, if the reduced portions 82*a* are excessively thin, it can be estimated that there is a case where metal movement of the raised part 82*b* is difficult to be realized in a cross section, and a percentage of the metal movement in the longitudinal direction of the material to be rolled A becomes large.

Accordingly, the present inventors conducted evaluation regarding shaping property under conditions where a web reduction amount was changed during rolling and shaping in the fifth caliber K5 at a time of performing rolling and shaping using the first caliber K1 to the sixth caliber K6 according to the present embodiment in a case of producing H-shaped steel with a product flange width of 400 mm or more by using a rectangular cross-section slab of 2000×300 mm as a raw material. As concrete conditions, cases where thicknesses after reduction of the reduced portions 82*a* were set to 200 mm, 160 mm, 140 mm, 120 mm, and 100 mm, were set to levels 1 to 5, respectively. Note that as a comparative level, a case where the web thickness reduction is performed without forming the raised part 82*b*, was set to a level 6. Here, in any of the conditions of the levels 1 to 5 and 6, a thickness of the caliber facing the raised part 82*b* in the fifth caliber K5 being the raised part forming caliber is set to be thicker than the slab thickness without depending on a roll gap. Specifically, it was set that even when the thickness of the reduced portions 82*a* of the both end parts of the web is reduced by the rolling in the fifth caliber K5, the thickness of the raised part 82*b* is not reduced by the caliber.

In this case, if the escaping percentage is "25% to 50%" being the desirable numerical value range, elongation of the material to be rolled in the rolling longitudinal direction does not occur, and the thickness of the raised part 82*b* becomes almost the same as the slab thickness under any of the conditions of the levels 1 to 5 and 6. In this evaluation, the slab thickness was set to 300 mm, so that the thickness of the raised part 82*b* which is formed in the fifth caliber K5 also becomes about 300 mm.

Table 1 to be shown below indicates pass schedules of the aforementioned level 1 to level 6, and respective calibers G1, G2-2, G3-1, G3-2, G4-1, and G4-2 in Table correspond to the first caliber K1 to the sixth caliber K6 described in the present embodiment. Further, the evaluation of the shaping property is described in the lowest column in Table 1, in which a case where the poor material passage and the defective shape occurred is evaluated as "bad", and a case where the poor material passage and the defective shape did not occur is evaluated as "good".

TABLE 1

| | LEVEL 1<br>**2000 WIDTH**<br>300 THICKNESS | LEVEL 2<br>**2000 WIDTH**<br>300 THICKNESS | LEVEL 3<br>**2000 WIDTH**<br>300 THICKNESS | LEVEL 4<br>**2000 WIDTH**<br>300 THICKNESS | LEVEL 5<br>**2000 WIDTH**<br>300 THICKNESS | LEVEL 6<br>**2000 WIDTH**<br>300 THICKNESS | WEB THICKNESS |
|---|---|---|---|---|---|---|---|
| **1** | **G1** | **G1** | **G1** | **G1** | **G1** | **G1** | ~ |
| **2** | **G1** | **G1** | **G1** | **G1** | **G1** | **G1** | ~ |
| **3** | **G1** | **G1** | **G1** | **G1** | **G1** | **G1** | ~ |
| **4** | **G2-2** | **G2-2** | **G2-2** | **G2-2** | **G2-2** | **G2-2** | ~ |
| **5** | **G2-2** | **G2-2** | **G2-2** | **G2-2** | **G2-2** | **G2-2** | ~ |
| **6** | **G2-2** | **G2-2** | **G2-2** | **G2-2** | **G2-2** | **G2-2** | ~ |

TABLE 1-continued

| | LEVEL 1 **2000 WIDTH** 300 THICKNESS | LEVEL 2 **2000 WIDTH** 300 THICKNESS | LEVEL 3 **2000 WIDTH** 300 THICKNESS | LEVEL 4 **2000 WIDTH** 300 THICKNESS | LEVEL 5 **2000 WIDTH** 300 THICKNESS | LEVEL 6 **2000 WIDTH** 300 THICKNESS | WEB THICKNESS |
|---|---|---|---|---|---|---|---|
| **7** | **G2-2** | **G2-2** | **G2-2** | **G2-2** | **G2-2** | **G2-2** | ~ |
| **8** | **G2-2** | **G2-2** | **G2-2** | **G2-2** | **G2-2** | **G2-2** | ~ |
| **9** | **G2-2** | **G2-2** | **G2-2** | **G2-2** | **G2-2** | **G2-2** | ~ |
| **10** | **G3-1** | **G3-1** | **G3-1** | **G3-1** | **G3-1** | **G3-1** | ~ |
| **11** | **G3-1** | **G3-1** | **G3-1** | **G3-1** | **G3-1** | **G3-1** | ~ |
| **12** | **G3-2** | **G3-2** | **G3-2** | **G3-2** | **G3-2** | **G3-2** | ~ |
| **13** | **G3-2** | **G3-2** | **G3-2** | **G3-2** | **G3-2** | **G3-2** | ~ |
| **14** | **G4-1** | **G4-1** | **G4-1** | **G4-1** | **G4-1** | \| | **280** |
| **15** | **G4-1** | **G4-1** | **G4-1** | **G4-1** | **G4-1** | \| | **260** |
| **16** | **G4-1** | **G4-1** | **G4-1** | **G4-1** | **G4-1** | \| | **240** |
| **17** | **G4-1** | **G4-1** | **G4-1** | **G4-1** | **G4-1** | \| | 200 |
| **18** | | **G4-1** | **G4-1** | **G4-1** | **G4-1** | \| | **180** |
| **19** | | **G4-1** | **G4-1** | **G4-1** | **G4-1** | \| | 160 |
| **20** | | | **G4-1** | **G4-1** | **G4-1** | \| | **150** |
| **21** | | | **G4-1** | **G4-1** | **G4-1** | \| | 140 |
| **22** | | | | **G4-1** | **G4-1** | \| | **130** |
| **23** | | | | **G4-1** | **G4-1** | \| | 120 |
| **24** | | | | | **G4-1** | \| | **110** |
| **25** | | | | | **G4-1** | ↓ | 100 |
| **26** | **G4-2** | **G4-2** | **G4-2** | **G4-2** | **G4-2** | **G4-2** | **280** |
| **27** | **G4-2** | **G4-2** | **G4-2** | **G4-2** | **G4-2** | **G4-2** | **260** |
| **28** | **G4-2** | **G4-2** | **G4-2** | **G4-2** | **G4-2** | **G4-2** | **240** |
| **29** | **G4-2** | **G4-2** | **G4-2** | **G4-2** | **G4-2** | **G4-2** | 200 |
| **30** | | **G4-2** | **G4-2** | **G4-2** | **G4-2** | **G4-2** | **180** |
| **31** | | **G4-2** | **G4-2** | **G4-2** | **G4-2** | **G4-2** | 160 |
| **32** | | | **G4-2** | **G4-2** | **G4-2** | **G4-2** | **150** |
| **33** | | | **G4-2** | **G4-2** | **G4-2** | **G4-2** | 140 |
| **34** | | | | **G4-2** | **G4-2** | **G4-2** | **130** |
| **35** | | | | **G4-2** | **G4-2** | **G4-2** | 120 |
| **36** | | | | | **G4-2** | **G4-2** | **110** |
| **37** | | | | | **G4-2** | **G4-2** | 100 |
| ROLLING RESULT | GOOD | GOOD | GOOD | BAD | BAD | GOOD | |

As shown in Table 1, when the thicknesses after reduction of the reduced portions 82*a* were set to 200 mm, 160 mm, and 140 mm (levels 1 to 3), the poor material passage and the defective shape do not occur when eliminating the raised part 82*b*. On the other hand, when the thicknesses after reduction of the reduced portions 82*a* were set to 120 mm, and 100 mm (levels 4 and 5), the poor material passage and the defective shape occur when eliminating the raised part 82*b*. Further, when the web thickness reduction to 100 mm was performed without forming the raised part 82*b* (level 6), although poor rolling does not occur, the generation efficiency of flanges is not sufficient.

As described above, in each of the levels 1 to 5 shown in Table 1, the thickness of the raised part 82*b* in a cross section in a final pass of G4-1 (corresponding to the fifth caliber K5) is about 300 mm. After that, in G4-2 (corresponding to the sixth caliber K6), the rolling of the raised part 82*b* formed in G4-1 was performed under a pass schedule in which the raised part 82*b* is eliminated through passes whose number is the same as the number of passes through which the raised part 82*b* was formed.

Here, evaluation criteria of the shaping property will be described. The evaluation of the shaping property is performed based on warpage which occurs in the longitudinal direction of the material to be rolled A when performing the rolling and shaping of eliminating the raised part 82*b*.

Figure 9:
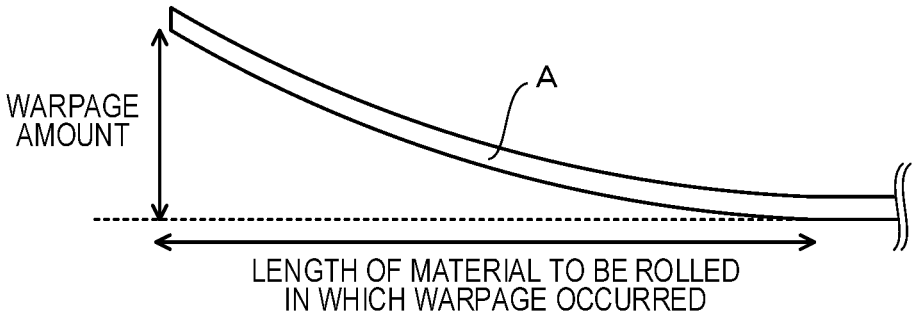
FIG. 9 is an explanatory view regarding warpage of a material to be rolled.

FIG. 9 is an explanatory diagram regarding warpage of the material to be rolled A, and is a schematic side view when warpage occurred in an end part in the longitudinal direction of the material to be rolled A. As illustrated in FIG. 9, a difference between an end part and a steady part when the warpage occurred in the end part in the longitudinal direction of the material to be rolled A, is defined as a "warpage amount". Further, a ratio of the generated warpage amount to the length in the longitudinal direction of the material to be rolled A in which the warpage occurred, is set to "warpage (%)" defined by the following formula (2).

$$\text{Warpage [\%]} = \text{warpage amount/length of material to be rolled in which warpage occurred} \quad (2)$$

Generally, an elongation length of the material to be rolled in a stage of rough rolling and shaping is about 10 m to 30 m, and a part where warpage occurs is in a range of several meters of a bite end. Further, self-correction is performed in the steady part because of an influence of its own weight, and thus large bending does not occur in the steady part. According to the verification conducted by the present inventors, it has been found out that when warpage on the order of several hundreds of millimeters occurs in the range of several meters of the bite end, an influence of the warpage is exerted on several meters of an end part to be an ejection end in rolling of the next pass, and there is generated a deviation in pass line, resulting in that a difference in thickness amount of upper and lower flanges is generated.

Figure 10:
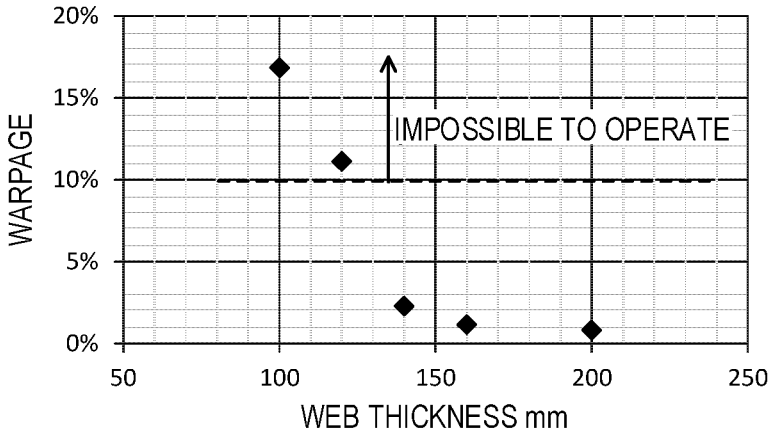
FIG. 10 is a graph indicating the relation between warpage and a web thickness.

The relation between the "warpage (%)" defined by the aforementioned formula (2) and the thickness after reduction of the reduced portions 82*a* was verified. FIG. 10 is a graph illustrating the relation between warpage and a web thickness (thickness after reduction of the reduced portions 82*a*). Note that the graph illustrated in FIG. 10 indicates data under a condition in which the escaping percentage was set to about 33%.

As illustrated in FIG. 10, there is a tendency that the smaller the thickness after reduction of the reduced portions 82*a*, the larger the warpage. In particular, it has been found out that when the thickness after reduction of the reduced portions 82*a* is 140 mm or more, the warpage is small to be about 3% or less, and when the thickness after reduction of the reduced portions 82*a* is less than 140 mm, the warpage is increased to be about 10% or more, and the shape deteriorates significantly.

In terms of operation, when the warpage occurred in the material to be rolled A becomes 10% or more, deterioration of dimension and shape in the next pass and thereafter becomes significant, and it becomes difficult to continue the rolling. Namely, from the result indicated in FIG. 10, it can be understood that good shaping property can be secured by performing the rolling and shaping in the fifth caliber K5 to make the web thickness (thickness after reduction of the reduced portions 82*a*) to be 140 mm or more. This matches the fact that the shaping property is good under the conditions of the levels 1 to 3 shown in Table 1.

Here, the reason why the threshold regarding the warpage is set to 10%, is because when the maximum warpage amount of about several hundreds of millimeters occurs at a percentage of 10% with respect to several meters of the end part of the material to be rolled, a difference in upper and lower thickness amounts is generated, which can be easily confirmed by a person skilled in the art, and a value at which it is apparent that the rolling becomes difficult to be continued in terms of operation is 10%.

Note that when the warpage is several % (less than 10%) under the same condition, warpage to a degree of several tens of millimeters is normally observed during operation, but, the degree has no problem in terms of operation, which can be easily estimated by the person skilled in the art.

(Relation Between Escaping Percentage and Web Thickness)

As described above while referring to FIG. 8, it was found out that the numerical value range of the escaping percentage is desirably set to 25% to 50% from a viewpoint of increasing the flange width. Further, as described above while referring to FIG. 9 and FIG. 10, it was found out that, in order to secure the good shaping property, it is desirable to perform the rolling and shaping in the fifth caliber K5 to make the web thickness (the thickness after reduction of the reduced portions 82*a*) to be a predetermined value or more (140 mm or more at an escaping percentage of 33%).

Here, according to the studies conducted by the present inventors, it has been confirmed that when the escaping percentage is changed, a value of a minimum web thickness (thickness after reduction of the reduced portions 82*a*) capable of securing good shaping property is also changed, and, for example, it has been found out that the larger the escaping percentage, the larger the value of the web thickness (the thicker the web thickness) capable of securing good shaping property.

Figure 11:
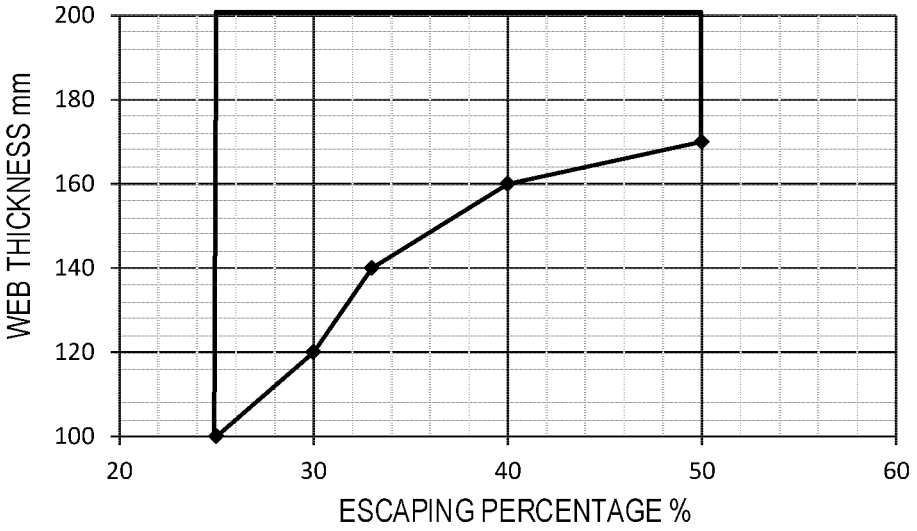
FIG. 11 is a graph indicating the relation between the escaping percentage and a minimum web thickness capable of securing good shaping property.

FIG. 11 is a graph indicating the relation between the escaping percentage and the minimum web thickness (web thickness in the drawing) capable of securing good shaping property. As illustrated in FIG. 11, when the escaping percentage is about 25%, even if the rolling and shaping is performed in the fifth caliber K5 until when the web thickness becomes about 100 mm, it is possible to perform the rolling and shaping in the sixth caliber K6 without causing the poor material passage and the defective shape when eliminating the raised part 82*b*. Further, when the escaping percentage is about 50%, if the rolling and shaping is performed in the fifth caliber K5 until when the web thickness becomes about less than 170 mm, the poor material passage and the defective shape are caused when eliminating the raised part 82*b*.

Specifically, it can be understood that by setting the condition of the rolling and shaping in the fifth caliber K5 to a condition in a range surrounded by a solid line illustrated in FIG. 11, it is possible to perform stable rolling and shaping in which good shaping property is secured. Concretely, good shaping property is secured by defining the escaping percentage to 25% to 50%, and defining a rolling and shaping condition such that thickness reduction is performed to a web thickness (thickness after reduction of the reduced portions 82*a*) which falls within a predetermined numerical value range determined in accordance with each escaping percentage.

Although FIG. 11 indicates the experimentally-derived condition and range, a lower limit value regarding the web thickness can be defined by the following mathematical formula (3) through primary regression based on derived plot values.

$$Y=-0.118X^2+11.732X-121.15 \quad (3)$$

Here, Y indicates the web thickness (mm), and X indicates the escaping percentage (%).

Specifically, according to FIG. 11, by defining the escaping percentage to 25% to 50%, and defining the web thickness which falls within the predetermined numerical value range determined in accordance with each escaping percentage while making the lower limit value of the web thickness to be determined by the aforementioned formula (3), good shaping property is secured.

According to the above-described method for producing H-shaped steel according to the present embodiment, it is set that the flat shaping and rolling implemented after the so-called edging rolling step is implemented by a caliber configuration including the fifth caliber K5 of forming the raised part 82*b* and the sixth caliber K6 of eliminating the raised part 82*b* and widening the inner size of the web part 82. Further, in the flat shaping and rolling implemented in such a step, the escaping percentage in the fifth caliber K5 which is called the "web partial rolling caliber" or the "raised part forming caliber" is set to 25% to 50%, and the rolling and shaping condition in which the thickness reduction is performed to the web thickness which falls within the predetermined numerical value range determined in accordance with each escaping percentage, is defined. This makes it possible to suppress the occurrence of the poor material passage and the defective shape in the sixth caliber K6 which is called the "raised part eliminating caliber", and to realize the improvement of generation efficiency of flanges.

One example of the embodiment of the present invention has been explained above, but, the present invention is not limited to the illustrated embodiment. It should be understood that various changes or modifications are readily apparent to those skilled in the art within the scope of the spirit as set forth in claims, and those should also be covered by the technical scope of the present invention.

For example, the technique of performing the shaping of the material to be rolled A using four calibers of the first caliber K1 to the fourth caliber K4, and thereafter performing the rolling and shaping of the H-shaped raw blank using the fifth caliber K5, the sixth caliber K6 (and the widening rolling calibers as needed) is explained in the above embodiment, but, the number of calibers for performing the rough rolling step is not limited to this, and the rolling and shaping step illustrated in the first caliber K1 to the fourth caliber K4 may be implemented using more calibers.

Further, the above embodiment explains the flat shaping and rolling step such that the raised part 82*b* is formed in the fifth caliber K5, and then the raised part 82*b* is eliminated in the sixth caliber K6, and the formation of the raised part in the fifth caliber K5 and the elimination of the raised part in the sixth caliber may also be conducted repeatedly. Specifically, it is also possible to repeatedly perform the flat shaping and rolling by the fifth caliber K5 and the sixth caliber K6 until when the web thickness after eliminating the raised part becomes the desired thickness. Note that even in such a case, there is a need to perform the flat shaping and rolling under the above-described condition in which the good shaping property can be secured while referring to FIG. 11.

Further, in the above embodiment, the shaping method of creating splits in the upper and lower end parts (slab end surfaces) of the material to be rolled A and performing processing of bending to right and left the respective portions separated to right and left by the splits to form the flange parts 80 in the first caliber K1 to the fourth caliber K4 is explained. However, the rolling and shaping technique using the fifth caliber K5 and the sixth caliber K6 according to the present invention is applicable not only to the material to be rolled A shaped by such a technique but also, for example, to a conventional H-shaped raw blank (so-called dog-bone material) represented by Patent Document 1.

EXAMPLE

As examples of the present invention, flange shapes after rolling and shaping in a raised part eliminating caliber (the sixth caliber K6 in the above embodiment) were compared between the conventional technique and the technique of the present invention. Note that in this example, a so-called 300 thick slab was used as a raw material and the rolling and shaping was performed under the condition indicated in the level 3 in Table 1 explained in the above embodiment, and in a comparative example, the rolling and shaping was performed under the condition indicated in the level 6 in Table 1 explained in the above embodiment.

Figure 12:
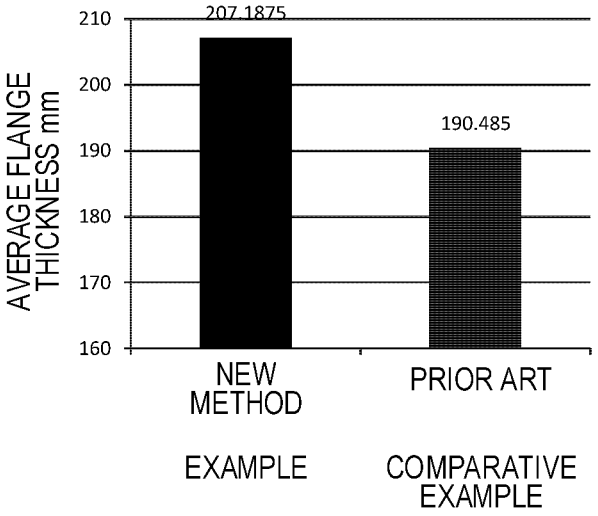
FIG. 12 is a graph indicating an average flange thickness after flat rolling and shaping according to an example and an average flange thickness after flat rolling and shaping according to a comparative example.

FIG. 12 is a graph indicating an average flange thickness after the flat rolling and shaping according to the example and an average flange thickness after the flat rolling and shaping according to the comparative example. Note that the average flange thickness indicates an average value of flange thicknesses measured at four tip points of the rolled and shaped flange parts.

As illustrated in FIG. 12, the average flange thickness after the flat rolling and shaping according to the example is increased by about 17 mm, namely, increased by about 9% in terms of ratio, when compared to the comparative example. Specifically, the generation efficiency of flanges is improved in the example, and it can be understood that in the method for producing H-shaped steel according to the present invention, an H-shaped raw blank having a larger flange thickness as compared with the conventional one is shaped in the rolling and shaping of the H-shaped raw blank. As a result of this, the generation efficiency of flanges is improved more when compared to the prior art, and a large-size H-shaped steel product is efficiently and stably produced.

INDUSTRIAL APPLICABILITY

The present invention is applicable to a production method for producing H-shaped steel using, for example, a slab having a rectangular cross section or the like as a raw material.

EXPLANATION OF CODES

1 . . . rolling facility
2 . . . heating furnace
3 . . . sizing mill
4 . . . rough rolling mill
5 . . . intermediate universal rolling mill
8 . . . finishing universal rolling mill
9 . . . edger rolling mill
11 . . . slab
13 . . . H-shaped raw blank
14 . . . intermediate material
16 . . . H-shaped steel product
20 . . . upper caliber roll (first caliber)
21 . . . lower caliber roll (first caliber)
25, 26 . . . projection (first caliber)
28, 29 . . . split (first caliber)
30 . . . upper caliber roll (second caliber)
31 . . . lower caliber roll (second caliber)
35, 36 . . . projection (second caliber)
38, 39 . . . split (second caliber)
40 . . . upper caliber roll (third caliber)
41 . . . lower caliber roll (third caliber)
45, 46 . . . projection (third caliber)
48, 49 . . . split (third caliber)
50 . . . upper caliber roll (fourth caliber)
51 . . . lower caliber roll (fourth caliber)
55, 56 . . . projection (fourth caliber)
58, 59 . . . split (fourth caliber)
80 . . . flange part
82 . . . web part
82*a* . . . reduced portion
82*b* . . . raised part (unreduced portion)
85 . . . upper caliber roll (fifth caliber)
85*a* . . . recessed part
86 . . . lower caliber roll (fifth caliber)
86*a* . . . recessed part
95 . . . upper caliber roll (sixth caliber)
96 . . . lower caliber roll (sixth caliber)
K1 . . . first caliber
K2 . . . second caliber
K3 . . . third caliber
K4 . . . fourth caliber
K5 . . . fifth caliber (web partial rolling caliber)
K6 . . . sixth caliber (raised part eliminating caliber)
T . . . production line
A . . . material to be rolled

What is claimed is:

1. A method for producing H-shaped steel, the method comprising:

a rough rolling step;

an intermediate rolling step; and a finish rolling step, wherein: a rectangular cross-section slab having a thickness of 290 mm or more and 310 mm or less is used as a raw material;

the rough rolling step comprises:

an edging rolling step of rolling and shaping the material into a predetermined shape including a web part; and a flat rolling step of rotating the material after completion of the edging rolling step by 90 degrees or 270 degrees and performing rolling of the web part of the material;

the flat rolling step further comprising forming a raised part at a middle of the web part of the material using recessed parts of upper and lower caliber rolls having of at least one caliber of a plurality of calibers, each of the recessed parts being provided at respective middle parts along a respective roll barrel of the upper and lower caliber rolls;

a width of the raised part formed in the flat rolling step is set to 25% or more and 50% or less of a width of the web part of the material; and a thickness of the web part rolled in the flat rolling step is set to a predetermined thickness in a range of values, a lower limit value of the range of values of the predetermined thickness being expressed by the following formula (3), $$Y=-0.118X^2+11.732X-121.15 \quad (3)$$

where Y indicates the web thickness (mm) of the web part rolled in the flat rolling step, and X indicates an escaping percentage (%) equaling (width of the raised part L1/the width of the web part L2)×100.

2. The method for producing the H-shaped steel according to claim 1, wherein the plurality of calibers further comprise a raised part eliminating caliber; and the flat rolling step further comprises reducing the raised part, with respect to the material formed with the raised part, using the raised part eliminating caliber.

3. The method for producing the H-shaped steel according to claim 2, wherein the plurality of calibers further comprise one or a plurality of widening calibers; and the flat rolling step further comprises, after the rolling and shaping by the raised part eliminating caliber, widening the web part with respect to the material using the one or the plurality of widening calibers.

4. The method for producing the H-shaped steel according to claim 1, wherein:

the edging rolling is performed using a plurality of caliber rolls engraved with a plurality of edging calibers, and a number of the plurality of edging calibers and the at least one caliber of the plurality of calibers being a total of six or more, with the at least one caliber of the plurality of calibers located at subsequent stages to the plurality of edging caliber;

the rough rolling step comprises performing the edging rolling step and the flat rolling step in one or a plurality of passes using the total number of caliber;

the edging rolling further comprises forming divided parts at end parts of the material by creating splits vertical to a width direction of the material using a first caliber and a second caliber of the plurality of edging calibers each having projections; and sequentially bending the formed divided parts using calibers of the plurality of edging calibers, located after a third caliber and excluding the calibers of the flat rolling step, by contacting the splits with projections.

* * * * *